US010565957B2

(12) United States Patent
Rao

(10) Patent No.: US 10,565,957 B2
(45) Date of Patent: Feb. 18, 2020

(54) GAMUT MAPPING METHOD AND DEVICE FOR COMPRESSING OUT-OF-GAMUT AREA TO IN-OF-GAMUT AREA, STORAGE MEDIUM, AND ELECTRONIC DEVICE

(71) Applicant: SHENZHEN CHINA STAR OPTOELECTRONICS TECHNOLOGY CO., LTD., Guangdong (CN)

(72) Inventor: Yang Rao, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/087,652

(22) PCT Filed: Aug. 16, 2018

(86) PCT No.: PCT/CN2018/100864
§ 371 (c)(1),
(2) Date: Sep. 23, 2018

(65) Prior Publication Data

US 2019/0385566 A1 Dec. 19, 2019

(30) Foreign Application Priority Data

Jun. 19, 2018 (CN) ..... 2018 1 0632205

(51) Int. Cl.
*G09G 5/02* (2006.01)

(52) U.S. Cl.
CPC ..... *G09G 5/02* (2013.01); *G09G 2320/0242* (2013.01); *G09G 2320/0271* (2013.01); *G09G 2320/0666* (2013.01); *G09G 2340/06* (2013.01)

(58) Field of Classification Search
CPC ..... G09G 5/02; G09G 2320/0242
See application file for complete search history.

(56) References Cited

U.S. PATENT DOCUMENTS 5,754,184 A * 5/1998 Ring ..... G06T 11/001 345/604
10,242,461 B1 * 3/2019 Rao ..... G06T 7/90
2004/0263528 A1 * 12/2004 Murdoch ..... G09G 3/3208 345/600
2005/0275912 A1 * 12/2005 Chen ..... G09G 5/02 358/523

(Continued)

FOREIGN PATENT DOCUMENTS

CN 106934835 A 7/2017
CN 107680142 A 2/2018

(Continued)

*Primary Examiner* — Jitesh Patel
(74) *Attorney, Agent, or Firm* — Mark M. Friedman

(57) ABSTRACT

The present disclosure provides a gamut mapping method including acquiring a first coordinate value of a target pixel point P in a Lab color space according to digital values of the target pixel point P in a large gamut area; determining a hue plane in which the target pixel point P is located, and determining (H, C, L) of the target pixel point P; mapping the target pixel point P to the small gamut area to acquire a second coordinate value of a mapped pixel point $P_1$ in the Lab color space; and acquiring mapped digital values of the mapped pixel point $P_1$ in the small gamut area.

16 Claims, 3 Drawing Sheets

(56) References Cited

U.S. PATENT DOCUMENTS

| | | | | |
|---|---|---|---|---|
| 2007/0171441 | A1* | 7/2007 | Granger | H04N 1/6027 358/1.9 |
| 2007/0171442 | A1* | 7/2007 | Granger | H04N 1/6022 358/1.9 |
| 2008/0112026 | A1* | 5/2008 | Kishimoto | G06T 11/001 358/518 |
| 2010/0123731 | A1* | 5/2010 | Morimoto | G09G 3/3406 345/589 |
| 2011/0012920 | A1* | 1/2011 | Saigo | G06T 11/001 345/601 |
| 2012/0139937 | A1* | 6/2012 | Marcu | G09G 3/2003 345/590 |
| 2013/0156334 | A1 | 6/2013 | Margerm et al. | |

FOREIGN PATENT DOCUMENTS

| | | | |
|---|---|---|---|
| CN | 107705264 | A | 2/2018 |
| JP | 2015089056 | A | 5/2015 |

* cited by examiner

GAMUT MAPPING METHOD AND DEVICE FOR COMPRESSING OUT-OF-GAMUT AREA TO IN-OF-GAMUT AREA, STORAGE MEDIUM, AND ELECTRONIC DEVICE

BACKGROUND

Field

The present disclosure relates to a technological field of displays, and more particularly to a gamut mapping method and device, a storage medium, and an electronic device.

Background

In a process of mapping a large gamut area to a small gamut area, the Gamut Mapping algorithm combines with an analysis of a constant hue plane (an LC plane) of a Lab color space. In a common algorithm, for example, a minimum chromatic aberration method, gamut points located outside the small gamut area are mapped to a border of the small gamut area. A serious problem of overlapping mapping exists. This directly leads to loss of a detail level of a mapped image, and halo noise phenomenon occurs.

Consequently, defects exist in the prior art and urgently need to be improved.

SUMMARY OF THE DISCLOSURE

An objective of embodiments of the present disclosure is to provide a gamut mapping method and device for compressing an out-of-gamut area to an in-of-gamut area, a storage medium, and an electronic device having beneficial effect of avoiding overlapping mapping and halo noise phenomenon.

The present disclosure provides a gamut mapping method for compressing an out-of-gamut area to an in-of-gamut area utilized for mapping a pixel point in a large gamut area of the out-of-gamut area to a small gamut area of the in-of-gamut area. The method includes the following steps of: acquiring a first coordinate value of a target pixel point P in a Lab color space according to digital values of the target pixel point P in the large gamut area; determining a hue plane in which the target pixel point P is located according to the first coordinate value, and determining (H, C, L) of the target pixel point P, wherein H is a hue angle of the target pixel point P and (C, L) is a coordinate of the target pixel point P in the hue plane; mapping the target pixel point P to the small gamut area according to (H, C, L) to acquire a second coordinate value of a mapped pixel point $P_1$ in the Lab color space; and acquiring mapped digital values of the mapped pixel point $P_1$ in the small gamut area according to the second coordinate value. The step of mapping the target pixel point P to the small gamut area according to (H, C, L) to acquire the second coordinate value of the mapped pixel point $P_1$ in the Lab color space includes: determining that the target pixel point P is located outside the small gamut area or inside the small gamut area according to values of C and L; acquiring a first reference point $P_i$ ($C(P_i)$, $L(P_i)$) of the target pixel point P in the small gamut area when the target pixel point P is located inside the small gamut area, wherein $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $\alpha$ is a preset adjusting coefficient. $\alpha\in[0, 1]$; determining that the target pixel point P is located in a left side of the first reference point $P_i$ or a right side; and serving the first coordinate value of the target pixel point P as the second coordinate value of the mapped pixel point $P_1$ in the Lab color space when the target pixel point P is located in the left side of the first reference point $P_i$. The step of acquiring the mapped digital values of the mapped pixel point $P_1$ in the small gamut area according to the second coordinate value includes: transforming a coordinate value of the mapped pixel point $P_1$ in the Lab color space into XYZ tristimulus values; transforming the XYZ tristimulus values into RGB optical values by an inverse of a TM matrix; and inversely transforming the RGB optical values back into the mapped digital values of the mapped pixel point $P_1$.

In the gamut mapping method for compressing the out-of-gamut area to the in-of-gamut area of the present disclosure, the step of mapping the target pixel point P to the small gamut area according to (H, C, L) to acquire the second coordinate value of the mapped pixel point $P_1$ in the Lab color space further includes: determining a second reference point $P_s$ when the target pixel point P is located in the right side of the first reference point $P_i$, wherein $P_s$ is a connection point of an extending line in a border of the large gamut area, and the extending line connects the target pixel point P with $P_C$; and determining a coordinate value P' ($C_{p'}$, $L_{p'}$) in the small gamut area according to the second reference point $P_s$, wherein $L_p=LLF$, $C_p=(|PP_C|+|P_CP_i|)*|P_iP_C|)/(|P_SP_C|+|P_CP_i|)+C(P_i)$.

In the gamut mapping method for compressing the out-of-gamut area to the in-of-gamut area of the present disclosure, the step of mapping the target pixel point P to the small gamut area according to (H, C, L) to acquire the second coordinate value of the mapped pixel point $P_1$ in the Lab color space further includes: acquiring the first reference point $P_i$($C(P_i)$, $L(P_i)$) of the target pixel point P in the small gamut area and a second reference point $P_s$ when the target pixel point P is located outside the small gamut area, wherein $P_s$ is a connection point of an extending line in a border of the large gamut area, the extending line connects the target pixel point P with $P_C$, $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $P_C$ is a vertical connection point of the target pixel point P in a border of the small gamut area, and $L_F$ is a vertical connection point of $P_C$ in the vertical axis; and determining a coordinate value P'($C_{p'}$, $L_{p'}$) in the small gamut area according to the second reference point $P_s$, wherein $L_{p'}=L(L_F)$, and $C_{p'}=(|PP_C|+|P_CP_i|)*|P_iP_C|)/(|P_SP_C|+|P_CP_i|)+C(P_i)$.

In the gamut mapping method for compressing the out-of-gamut area to the in-of-gamut area of the present disclosure, the step of acquiring the first coordinate value of the target pixel point P in the Lab color space according to the digital values of the target pixel point P in the large gamut area includes: transforming the digital values of the target pixel point P into the RGB optical values; transforming the RGB optical values into the XYZ tristimulus values by the TM matrix; and transforming the XYZ tristimulus values into the first coordinate of the target pixel point P in the Lab color space.

The present disclosure further discloses a gamut mapping method for compressing an out-of-gamut area to an in-of-gamut area utilized for mapping a pixel point in a large gamut area of the out-of-gamut area to a small gamut area of the in-of-gamut area. The method includes the following steps of: acquiring a first coordinate value of a target pixel point P in a Lab color space according to digital values of the target pixel point P in the large gamut area; determining a hue plane in which the target pixel point P is located according to the first coordinate value, and determining (H, C, L) of the target pixel point P, wherein H is a hue angle of the target pixel point P and (C, L) is a coordinate of the target pixel point P in the hue plane; mapping the target pixel point P to the small gamut area according to (H, C, L) to acquire a second coordinate value of a mapped pixel point $P_1$ in the Lab color space; and acquiring mapped digital values of the mapped pixel point $P_1$ in the small gamut area according to the second coordinate value.

In the gamut mapping method for compressing the out-of-gamut area to the in-of-gamut area of the present disclosure, the step of mapping the target pixel point P to the small gamut area according to (H, C, L) to acquire the second coordinate value of the mapped pixel point $P_1$ in the Lab color space includes: determining that the target pixel point P is located outside the small gamut area or inside the small gamut area according to values of C and L; acquiring a first reference point $P_i$ ($C(P_i)$, $L(P_i)$) of the target pixel point P in the small gamut area when the target pixel point P is located inside the small gamut area, wherein $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $\alpha$ is a preset adjusting coefficient. $\alpha\in[0, 1]$; determining that the target pixel point P is located in a left side of the first reference point $P_i$ or a right side; and serving the first coordinate value of the target pixel point P as the second coordinate value of the mapped pixel point $P_1$ in the Lab color space when the target pixel point P is located in the left side of the first reference point $P_i$.

In the gamut mapping method for compressing the out-of-gamut area to the in-of-gamut area of the present disclosure, the step of mapping the target pixel point P to the small gamut area according to (H, C, L) to acquire the second coordinate value of the mapped pixel point $P_1$ in the Lab color space further includes: determining a second reference point $P_s$ when the target pixel point P is located in the right side of the first reference point $P_i$, wherein $P_s$ is a connection point of an extending line in a border of the large gamut area, and the extending line connects the target pixel point P with $P_C$; and determining a coordinate value P' ($C_{p'}$, $L_{p'}$) in the small gamut area according to the second reference point $P_s$, wherein $L_{p'}=LLF$, $C_{p'}=(|PP_C|+|P_CP_i|)*|P_iP_C|)/(|P_SP_C|+|P_CP_i|)+C(P_i)$.

In the gamut mapping method for compressing the out-of-gamut area to the in-of-gamut area of the present disclosure, the step of mapping the target pixel point P to the small gamut area according to (H, C, L) to acquire the second coordinate value of the mapped pixel point $P_1$ in the Lab color space further includes: acquiring the first reference point $P_i$ ($C(P_i)$, $L(P_i)$) of the target pixel point P in the small gamut area and a second reference point $P_s$ when the target pixel point P is located outside the small gamut area, wherein $P_s$ is a connection point of an extending line in a border of the large gamut area, the extending line connects the target pixel point P with $P_C$, $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $P_C$ is a vertical connection point of the target pixel point P in a border of the small gamut area, and $L_F$ is a vertical connection point of $P_C$ in the vertical axis; and determining a coordinate value P' ($C_{p'}$, $L_{p'}$) in the small gamut area according to the second reference point $P_s$, wherein $L_{p'}=L(L_F)$, and $C_{p'}=(|PP_C|+|P_CP_i|)*|P_iP_C|)/(|P_SP_C|+|P_CP_i|)+C(P_i)$.

In the gamut mapping method for compressing the out-of-gamut area to the in-of-gamut area of the present disclosure, the step of acquiring the mapped digital values of the mapped pixel point $P_1$ in the small gamut area according to the second coordinate value includes: transforming a coordinate value of the mapped pixel point $P_1$ in the Lab color space into XYZ tristimulus values: transforming the XYZ tristimulus values into RGB optical values by an inverse of a TM matrix; and inversely transforming the RGB optical values back into the mapped digital values of the mapped pixel point $P_1$.

In the gamut mapping method for compressing the out-of-gamut area to the in-of-gamut area of the present disclosure, the step of acquiring the first coordinate value of the target pixel point P in the Lab color space according to the digital values of the target pixel point P in the large gamut area includes: transforming the digital values of the target pixel point P into RGB optical values; transforming the RGB optical values into XYZ tristimulus values by a TM matrix; and transforming the XYZ tristimulus values into the first coordinate of the target pixel point P in the Lab color space.

A storage medium is disclosed. The storage medium stores computer programs. A computer performs a gamut mapping method for compressing an out-of-gamut area to an in-of-gamut area when the programs are operated by the computer. The gamut mapping method for compressing the out-of-gamut area to the in-of-gamut area is utilized for mapping a pixel point in a large gamut area of the out-of-gamut area to a small gamut area of the in-of-gamut area. The method includes the following steps of: acquiring a first coordinate value of a target pixel point P in a Lab color space according to digital values of the target pixel point P in the large gamut area; determining a hue plane in which the target pixel point P is located according to the first coordinate value, and determining (H, C, L) of the target pixel point P, wherein H is a hue angle of the target pixel point P and (C, L) is a coordinate of the target pixel point P in the hue plane; mapping the target pixel point P to the small gamut area according to (H, C, L) to acquire a second coordinate value of a mapped pixel point $P_1$ in the Lab color space; and acquiring mapped digital values of the mapped pixel point $P_1$ in the small gamut area according to the second coordinate value.

In the storage medium of the present disclosure, the step of mapping the target pixel point P to the small gamut area according to (H, C, L) to acquire the second coordinate value of the mapped pixel point $P_1$ in the Lab color space includes: determining that the target pixel point P is located outside the small gamut area or inside the small gamut area according to values of C and L: acquiring a first reference point $P_i$ ($C(P_i)$, $L(P_i)$) of the target pixel point P in the small gamut area when the target pixel point P is located inside the small gamut area, wherein $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $\alpha$ is a preset adjusting coefficient. $\alpha\in[0, 1]$; determining that the target pixel point P is located in a left side of the first reference point $P_i$ or a right side; and serving the first coordinate value of the target pixel point P as the second coordinate value of the mapped pixel point $P_1$ in the Lab color space when the target pixel point P is located in the left side of the first reference point $P_i$.

In the storage medium of the present disclosure, the step of mapping the target pixel point P to the small gamut area according to (H, C, L) to acquire the second coordinate value of the mapped pixel point $P_1$ in the Lab color space further includes: determining a second reference point $P_s$ when the target pixel point P is located in the right side of the first reference point $P_i$, wherein $P_s$ is a connection point of an extending line in a border of the large gamut area, and the extending line connects the target pixel point P with $P_C$; and determining a coordinate value P' ($C_{p'}$, $L_{p'}$) in the small gamut area according to the second reference point $P_s$, wherein $L_{p'}$=LLF, $C_{p'}=(|PP_C|+|P_CP_i|)*|P_iP_C|)/(|P_SP_C|+|P_CP_i|)+C(P_i)$.

In the storage medium of the present disclosure, the step of mapping the target pixel point P to the small gamut area according to (H, C, L) to acquire the second coordinate value of the mapped pixel point $P_1$ in the Lab color space further includes: acquiring the first reference point $P_i$ ($C(P_i)$, $L(P_i)$) of the target pixel point P in the small gamut area and a second reference point $P_s$ when the target pixel point P is located outside the small gamut area, wherein $P_s$ is a connection point of an extending line in a border of the large gamut area, the extending line connects the target pixel point P with $P_C$, $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $P_C$ is a vertical connection point of the target pixel point P in a border of the small gamut area, and $L_F$ is a vertical connection point of $P_C$ in the vertical axis; and determining a coordinate value P' ($C_{p'}$, $L_{p'}$) in the small gamut area according to the second reference point $P_s$, wherein $L_{p'}=L(L_F)$, and $C_{p'}=(|PP_C|+|P_CP_i|)*|P_iP_C|)/(|P_SP_C|+|P_CP_i|)+C(P_i)$.

In the storage medium of the present disclosure, the step of acquiring the mapped digital values of the mapped pixel point $P_1$ in the small gamut area according to the second coordinate value includes: transforming a coordinate value of the mapped pixel point $P_1$ in the Lab color space into XYZ tristimulus values; transforming the XYZ tristimulus values into RGB optical values by an inverse of a TM matrix; and inversely transforming the RGB optical values back into the mapped digital values of the mapped pixel point $P_1$.

In the storage medium of the present disclosure, the step of acquiring the first coordinate value of the target pixel point P in the Lab color space according to the digital values of the target pixel point P in the large gamut area includes: transforming the digital values of the target pixel point P into RGB optical values; transforming the RGB optical values into XYZ tristimulus values by a TM matrix; and transforming the XYZ tristimulus values into the first coordinate of the target pixel point P in the Lab color space.

It can be understood from the above that in the present disclosure, the first coordinate value of the target pixel point P in the Lab color space is acquired according to the digital values of the target pixel point P in the large gamut area. The hue plane in which the target pixel point P is located is determined according to the first coordinate value. (H, C, L) of the target pixel point P is determined. H is the hue angle of the target pixel point P. (C, L) is the coordinate of the target pixel point P in the hue plane. The target pixel point P is mapped to the small gamut area according to (H, C, L) to acquire the second coordinate value of the mapped pixel point $P_1$ in the Lab color space. The mapped digital values of the mapped pixel point $P_1$ in the small gamut area are acquired according to the second coordinate value. The present disclosure has beneficial effect of avoiding the overlapping mapping and the halo noise phenomenon.

BRIEF DESCRIPTION OF THE DRAWINGS

To describe the technical solutions of the embodiments of the present disclosure more clearly, the following briefly introduces the accompanying drawings required for describing the embodiments. Apparently, the accompanying drawings in the following description show only some embodiments of the present disclosure, and those skilled in the art may still derive other drawings from these accompanying drawings without creative efforts.

DETAILED DESCRIPTION OF THE PREFERRED EMBODIMENTS

Figure 1:
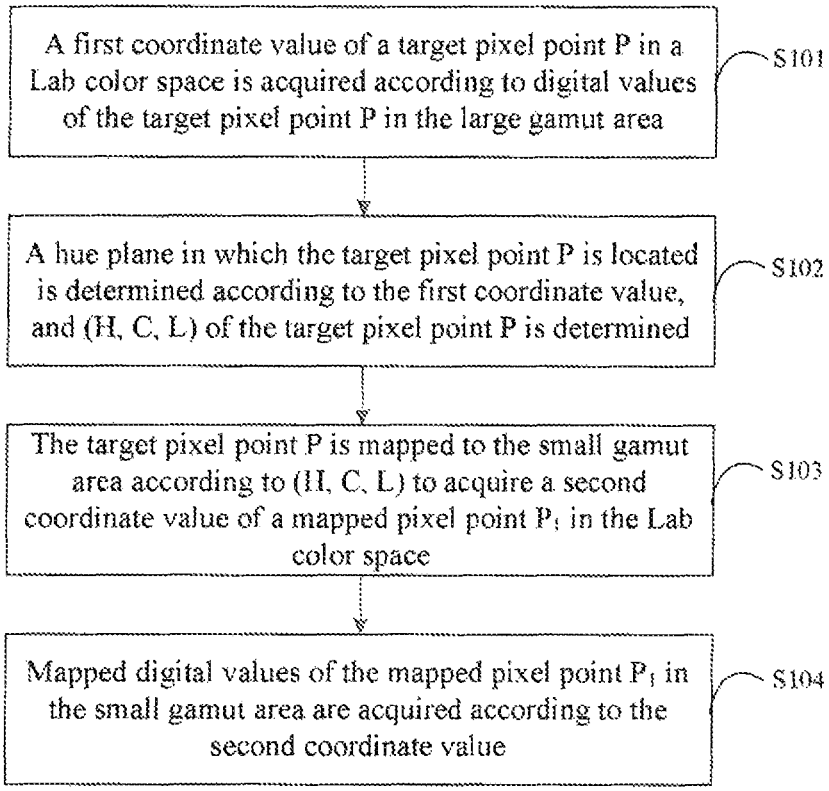
FIG. 1 illustrates a flow chart of a gamut mapping method for compressing an out-of-gamut area to an in-of-gamut area in accordance with some embodiment of the present disclosure.

Hereinafter, exemplary embodiments of the present disclosure will be described with reference to the accompanying drawings. The same or similar elements or the elements with the same or similar functions will be designated by the same or similar reference numerals throughout the following description and drawings. The following embodiments described with the accompanying drawings are merely exemplary to explain the present disclosure and not to be construed as limiting the present disclosure.

In the description of the present disclosure, it should be understood that orientations or position relationships indicated by the terms "center", "longitudinal", "lateral", "length", "width", "thickness", "upper", "lower", "front", "rear", "left", "right", "vertical", "horizontal", "top", "bottom", "inside", "outside", "clockwise", and "counter-clockwise" are based on orientations or position relationships illustrated in the drawings. The terms are used to facilitate and simplify the description of the present disclosure, rather than indicate or imply that the devices or elements referred to herein is required to have specific orientations or be constructed or operates in the specific orientations. Accordingly, the terms should not be construed as limiting the present disclosure. Furthermore, the terms "first" and "second" are for descriptive purposes only and should not be construed as indicating or implying relative importance or implying the number of technical features. As such, the features defined by the term "first" and "second" may include one or more of the features explicitly or implicitly. In the description of the present disclosure, the term "more" refers two or more than two, unless otherwise specifically defined.

In the description of the present disclosure, it should be noted that unless otherwise clearly defined and limited, the terms "mounted", "connected/coupled", and "connection" should be interoperated broadly. For example, the terms may refer to a fixed connection, a detachable connection, or an integral connection; the terms may also refer to a mechanical connection, an electrical connection, or communication with each other; the terms may further refer to a direct connection, an indirect connection through an intermediary, or an interconnection between two elements or interactive relationship between two elements. Those skilled in the art can understand the specific meanings of the above-mentioned terms in the present disclosure according to circumstances.

In the present disclosure, it should be noted that unless otherwise clearly defined and limited, a first feature "on" or "under" a second feature may mean that the first feature directly contacts the second feature, or that the first feature contacts the second feature via an additional feature there between instead of directly contacting the second feature. Moreover, the first feature "on", "above", and "over" the second feature may mean that the first feature is right over or obliquely upward over the second feature or mean that the first feature has a horizontal height higher than that of the second feature. The first feature "under". "below", and "beneath" the second feature may mean that the first feature is right beneath or obliquely downward beneath the second feature or mean that that horizontal height of the first feature is lower than that of the second feature.

The following description provides various embodiments or examples for implementing various structures of the present disclosure. To simplify the description of the present disclosure, parts and settings of specific examples are described as follows. Certainly, they are only illustrative, and are not intended to limit the present disclosure. Further, reference numerals and reference letters may be repeated in different examples. This repetition is for purposes of simplicity and clarity and does not indicate a relationship of the various embodiments and/or the settings. Furthermore, the present disclosure provides specific examples of various processes and materials, however, applications of other processes and/or other materials may be appreciated those skilled in the art.

Please refer to FIG. 1. FIG. 1 illustrates a gamut mapping method for compressing an out-of-gamut area to an in-of-gamut area. The method is utilized for mapping a pixel point in a large gamut area of the out-of-gamut area to a small gamut area of the in-of-gamut area. The method includes the following steps.

In step S101, a first coordinate value of a target pixel point P in a Lab color space is acquired according to digital values of the target pixel point P in the large gamut area.

In step S102, a hue plane in which the target pixel point P is located is determined according to the first coordinate value, and (H, C, L) of the target pixel point P is determined. H is a hue angle of the target pixel point P. (C, L) is a coordinate of the target pixel point P in the hue plane.

In step S103, the target pixel point P is mapped to the small gamut area according to (H, C, L) to acquire a second coordinate value of a mapped pixel point $P_1$ in the Lab color space.

In step S104, mapped digital values of the mapped pixel point $P_1$ in the small gamut area are acquired according to the second coordinate value.

The gamut mapping method for compressing the out-of-gamut area to the in-of-gamut area is described in detail in conjunction with the figures as follows.

In step S101, RGB digital values of each of the target pixel points P to be processed in a large gamut area QY1. Then, the RGB digital values of each of the target pixel points P are transformed into a first coordinate ($L_k$, a, b) of each of the target pixel points P in the Lab color space.

In detail, step S101 includes the following steps. In step S1011, the digital values of each of the target pixel points P are transformed into RGB optical values. In step S1012, the RGB optical values are transformed into XYZ tristimulus values by a TM matrix. In step S1013, the XYZ tristimulus values are transformed into a coordinate of each of the target pixel points P in the Lab color space. The digital values of each of the target pixel points P are transformed into the RGB optical values by a Gamma 2.2 calculation. The RGB optical values are transformed into the XYZ tristimulus values by the TM matrix. Finally, the XYZ tristimulus values are transformed into the first coordinate ($L_k$, a, b) of each of the target pixel points P in the Lab color space by a conventional calculation.

The XYZ tristimulus values may be transformed into L*a*b* values in the Lab color space by the following formulas:

$$L^* = 116f\left(\frac{Y}{Y_n}\right) - 16;$$

$$a^* = 500\left[f\left(\frac{X}{X_n}\right) - f\left(\frac{Y}{Y_n}\right)\right]; \text{ and}$$

$$b^* = 200\left[f\left(\frac{Y}{Y_n}\right) - f\left(\frac{Z}{Z_n}\right)\right].$$

$$f(t) = \begin{cases} t^{1/3} & \text{if } t > \left(\frac{6}{29}\right)^3 \\ \frac{1}{3}\left(\frac{29}{6}\right)^2 t + \frac{4}{29} & \text{otherwise} \end{cases}$$

Figure 2:
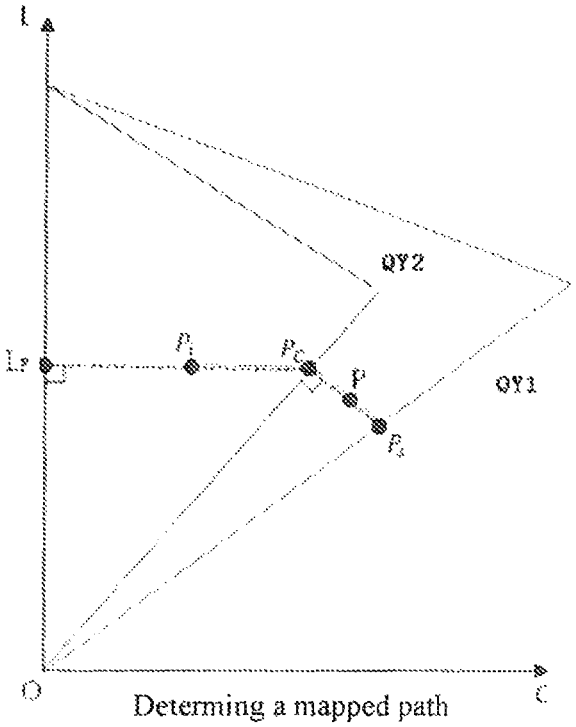
FIG. 2 illustrates a detailed principle of the gamut mapping method for compressing the out-of-gamut area to the in-of-gamut area in accordance with some embodiment of the present disclosure.

When a maximum luminance is normalized as 100, defaults of $X_n$, $Y_n$, and $Z_n$ are 95.047, 100, and 108.883. Please refer to FIG. 2. In step S102, the hue plane in which each of the target pixel points P is located is determined according to the first coordinate value. A small gamut area QY2 in the hue plane is a target gamut area required to be mapped. The small gamut area QY2 and the large gamut area QY1 intersect with a horizontal axis and a vertical axis of coordinate axes.

Figure 3:
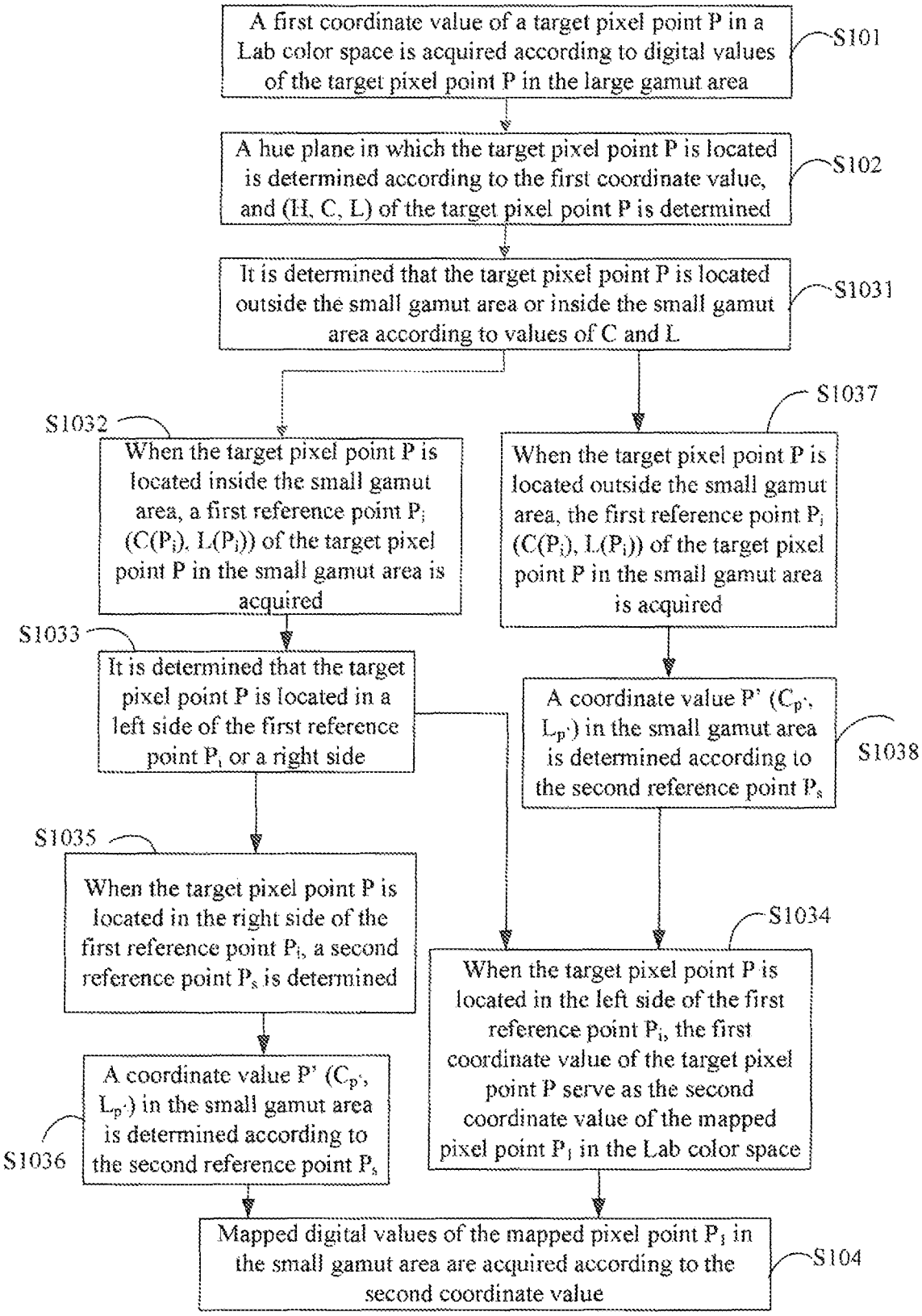
FIG. 3 illustrates another flow chart of a gamut mapping method for compressing an out-of-gamut area to an in-of-gamut area in accordance with some embodiment of the present disclosure.

Please refer to FIG. 3. Step S103 includes the following sub-steps.

In step S1031, it is determined that the target pixel point P is located outside the small gamut area or inside the small gamut area according to values of C and L.

In step S1032, when the target pixel point P is located inside the small gamut area, a first reference point $P_i$ ($C(P_i)$, $L(P_i)$) of the target pixel point P in the small gamut area is acquired. $C(P_i)=\alpha C(P_C)$. $L(P_i)=L(L_F)$. $P_C$ is a vertical connection point of the target pixel point P in a border of the small gamut area. $L_F$ is a vertical connection point of $P_C$ in the vertical axis. $\alpha$ is a preset adjusting coefficient. $\alpha \in [0, 1]$.

In step S1033, it is determined that the target pixel point P is located in a left side of the first reference point $P_i$ or a right side.

In step S1034, when the target pixel point P is located in the left side of the first reference point $P_i$, the first coordinate value of the target pixel point P serve as the second coordinate value of the mapped pixel point $P_1$ in the Lab color space.

In step S1035, when the target pixel point P is located in the right side of the first reference point $P_i$, a second reference point $P_s$ is determined. $P_s$ is a connection point of an extending line in a border of the large gamut area. The extending line connects the target pixel point P with $P_C$.

In step S1036, a coordinate value P' ($C_{p'}$, $L_{p'}$) in the small gamut area is determined according to the second reference point $P_s$. $L_{p'}$=LLF. $C_{p'}=(|PP_C|+|P_CP_i|)*|P_iP_C|)/(|P_SP_C|+|P_CP_i-)+C(P_i)$.

In step S1037, when the target pixel point P is located outside the small gamut area, the first reference point $P_i$ ($C(P_i)$, $L(P_i)$) of the target pixel point P in the small gamut area is acquired. $C(P_i)=\alpha C(P_C)$. $L(P_i)=L(L_F)$. $P_C$ is a vertical connection point of the target pixel point P in a border of the small gamut area. $L_F$ is a vertical connection point of $P_C$ in the vertical axis. $\alpha$ is a preset adjusting coefficient and aims to implement trade-off between minimizing chromatic aberration and maximizing detail. $\alpha \in [0, 1]$. The vertical connection points each refer to an intersection point of a corresponding line and a vertical line from a point to the corresponding line starting from a point.

In step S1038, a coordinate value P' ($C_{p'}$, $L_{p'}$) in the small gamut area is determined according to the second reference point $P_s$. $L_{p'}=LLF$. $C_{p'}=(|PP_C|+|P_CP_i|)*|P_iP_C|)/(P_SP_C|+|P_CP_i|)+C(P_i)$.

Step S104 includes the following sub-steps. In step S1041, a coordinate value of the mapped pixel point $P_1$ in the Lab color space is transformed into the XYZ tristimulus values. In step S1042, the XYZ tristimulus values are transformed into the RGB optical values by an inverse of the TM matrix. In step S1043, the RGB optical values are inversely transformed into the mapped digital values of the mapped pixel point $P_1$. The coordinate value in the Lab color space is transformed into the XYZ tristimulus values by a formula. The XYZ tristimulus values are transformed into the RGB optical values by the inverse of the TM matrix. The RGB optical values are inversely transformed into the RGB digital values by a Gamma 2.2 calculation. L*a*b* values in the Lab color space may be transformed back into the XYZ tristimulus values by the following formulas:

$$f\left(\frac{Y}{Y_n}\right) = \frac{L+16}{116};$$

$$f\left(\frac{X}{X_n}\right) = \frac{a}{500} + f\left(\frac{Y}{Y_n}\right);$$

$$f\left(\frac{Z}{Z_n}\right) = f\left(\frac{Y}{Y_n}\right) - b/200; \text{ and}$$

$$t = \begin{cases} f(t)\text{^}3 & \text{if } f(t) > \frac{6}{29} \\ \left(f(t) - \frac{4}{29}\right) \Big/ \left(\left(\frac{1}{3}\right) * (29/6)\text{^}2\right) & \text{otherwise} \end{cases}.$$

It can be understood from the above that in the present disclosure, the first coordinate value of the target pixel point P in the Lab color space is acquired according to the digital values of the target pixel point P in the large gamut area. The hue plane in which the target pixel point P is located is determined according to the first coordinate value. (H, C, L) of the target pixel point P is determined. H is the hue angle of the target pixel point P. (C, L) is the coordinate of the target pixel point P in the hue plane. The target pixel point P is mapped to the small gamut area according to (H, C, L) to acquire the second coordinate value of the mapped pixel point $P_1$ in the Lab color space. The mapped digital values of the mapped pixel point $P_1$ in the small gamut area are acquired according to the second coordinate value. The present disclosure has beneficial effect of avoiding the overlapping mapping and the halo noise phenomenon.

Figure 4:
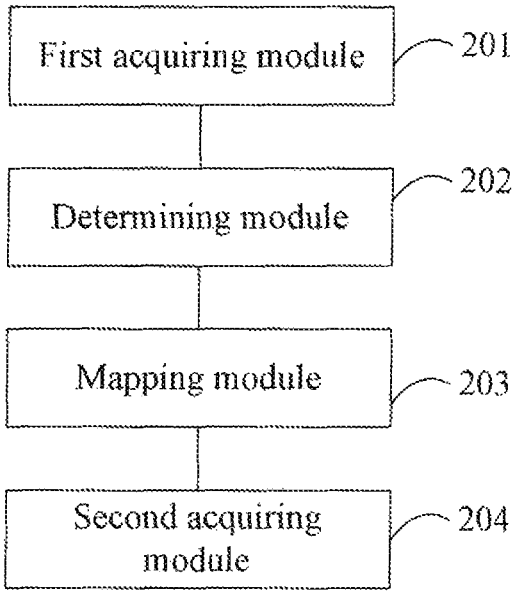
FIG. 4 illustrates a structural diagram of a gamut mapping device for compressing an out-of-gamut area to an in-of-gamut area in accordance with some embodiment of the present disclosure.
Figure 5:
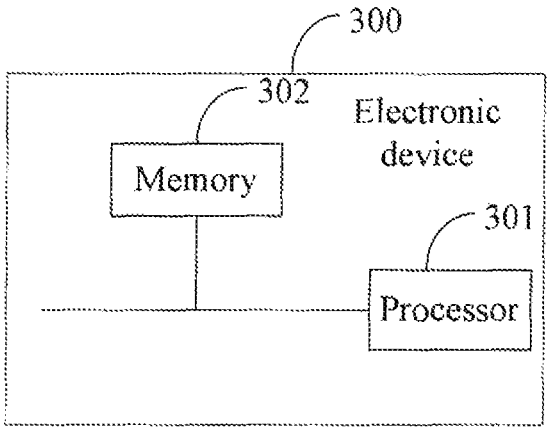
FIG. 5 illustrates a structural diagram of an electronic device in accordance with some embodiment of the present disclosure.

Please refer to FIG. 4. FIG. 4 illustrates a structural diagram of a gamut mapping device for compressing an out-of-gamut area to an in-of-gamut area. The device is utilized for mapping a pixel point in a large gamut area of the out-of-gamut area to a small gamut area of the in-of-gamut area. The device includes a first acquiring module 201, a determining module 202, a mapping module 203, and a second acquiring module 204.

The first acquiring module 201 is configured to acquire a first coordinate value of a target pixel point P in a Lab color space according to digital values of the target pixel point P in the large gamut area. The first acquiring module 201 is configured to: transform the digital values of the target pixel point P into RGB optical values; transform the RGB optical values into XYZ tristimulus values by a TM matrix; and transform the XYZ tristimulus values into a coordinate of the target pixel point P in the Lab color space. The digital values of the target pixel point P are transformed into the RGB optical values by a Gamma 2.2 calculation. The RGB optical values are transformed into the XYZ tristimulus values by the TM matrix. Finally, the XYZ tristimulus values are transformed into the first coordinate ($L_k$, a, b) of the target pixel point P in the Lab color space by a conventional calculation.

The determining module 202 is configured to determine a hue plane in which the target pixel point P is located according to the first coordinate value, and configured to determine (H, C, L) of the target pixel point P. H is a hue angle of the target pixel point P. (C, L) is a coordinate of the target pixel point P in the hue plane.

The mapping module 203 is configured to map the target pixel point P to the small gamut area according to (H, C, L) to acquire a second coordinate value of a mapped pixel point $P_1$ in the Lab color space. The mapping module 203 is configured to: determine that the target pixel point P is located outside the small gamut area or inside the small gamut area according to values of C and L; acquire a first reference point $P_i$ ($C(P_i)$, $L(P_i)$) of the target pixel point P in the small gamut area when the target pixel point P is located inside the small gamut area, wherein $C(P_i)=\alpha C(P_C)$, $L(P_i)=L(L_F)$, $P_C$ is a vertical connection point of the target pixel point P in a border of the small gamut area, and $L_F$ is a vertical connection point of $P_C$ in the vertical axis; determine that the target pixel point P is located in a left side of the first reference point $P_i$ or a right side; serve the first coordinate value of the target pixel point P as the second coordinate value of the mapped pixel point $P_1$ in the Lab color space when the target pixel point P is located in the left side of the first reference point $P_i$; determine a second reference point $P_s$ when the target pixel point P is located in the right side of the first reference point $P_i$, wherein $P_s$ is a connection point of an extending line in a border of the large gamut area, and the extending line connects the target pixel point P with $P_C$; determine a coordinate value P' ($C_{p'}$, $L_{p'}$) in the small gamut area according to the second reference point $P_s$, wherein $L_{p'}=LLF$, $C_{p'}=(|PP_C|+|P_CP_i|)*|P_iP_C|)/|P_SP_C|+|P_CP_i|)+C(P_i)$; acquire the first reference point $P_i$ ($C(P_i)$, $L(P_i)$) of the target pixel point P in the small gamut area when the target pixel point P is located outside the small gamut area, wherein $C(P_i)=\alpha C(P_C)$, $L(P_i)=L(L_F)$. $P_C$ is a vertical connection point of the target pixel point P in a border of the small gamut area, and $L_F$ is a vertical connection point of $P_C$ in the vertical axis; and determine a coordinate value P' ($C_{p'}$, $L_{p'}$) in the small gamut area according to the second reference point $P_s$, wherein $L_{p'}=L(L_F)$, and $C_{p'}=(|PP_C|+|P_CP_i|)*|P_iP_C|)/(|P_SP_C|+|P_CP_i|)+C(P_i)$.

The second acquiring module 204 is configured to acquire mapped digital values of the mapped pixel point $P_1$ in the small gamut area according to the second coordinate value. In some embodiments, the second acquiring module 204 includes a first transforming unit configured to transform a coordinate value of the mapped pixel point $P_1$ in the Lab color space into the XYZ tristimulus values; a second transforming unit configured to transform the XYZ tristimulus values into the RGB optical values by an inverse of the TM matrix; and a third transforming unit configured to inversely transform the RGB optical values back into the mapped digital values of the mapped pixel point $P_1$.

Please refer to FIG. 4. The present disclosure further provides an electronic device 300 including a processor 301 and a memory 302. The memory 302 stores computer programs. The processor 301 is configured to perform the above methods by calling the computer programs stored in the memory 302. The processor 301 is electrically connected to the memory 302. The processor 301 is a control center of the terminal 300. The processor 301 is connected to other elements by various interfaces and lines and is configured to perform various functions of a display device and process data by operating or calling the computer programs stored in the memory 302 and calling data stored in the memory 302, thereby controlling the display device.

In the present embodiment, the processor 301 of the electronic device 300 loads instructions corresponding to processes of one or more computer programs into the memory 302, and the processor 301 operates the computer programs stored in the memory 302 to implement various functions, for example, acquiring a first coordinate value of a target pixel point P in a Lab color space according to digital values of the target pixel point P in the large gamut area; determining a hue plane in which the target pixel point P is located according to the first coordinate value, and determining (H, C, L) of the target pixel point P, wherein H is a hue angle of the target pixel point P, and (C, L) is a coordinate of the target pixel point P in the hue plane; mapping the target pixel point P to the small gamut area according to (H, C, L) to acquire a second coordinate value of a mapped pixel point $P_1$ in the Lab color space; and acquiring mapped digital values of the mapped pixel point $P_1$ in the small gamut area according to the second coordinate value.

It should be noted that those skilled in the art may understand all or some of the processes in the methods of the embodiments described above can be realized by using computer programs to instruct corresponding hardware. The programs may be stored in a computer readable storage medium. The storage medium may include but is not limited to read-only memory (ROM), random access memory (RAM), disk, compact disc (CD), or the like.

The gamut mapping method and device for compressing the out-of-gamut area to the in-of-gamut area, the storage medium, and the electronic device provided by the embodiments of the present disclosure are described in detail as above. In summary, although the present disclosure has been provided in the preferred embodiments described above, the foregoing preferred embodiments are not intended to limit the present disclosure. Those skilled in the art, without departing from the spirit and scope of the present disclosure, may make modifications and variations, so the scope of the protection of the present disclosure is defined by the claims.

What is claimed is:

1. A gamut mapping method for compressing an out-of-gamut area to an in-of-gamut area, utilized for mapping a pixel point in a large gamut area of the out-of-gamut area to a small gamut area of the in-of-gamut area, wherein the method comprises the following steps of:

acquiring a first coordinate value of a target pixel point P in a Lab color space according to digital values of the target pixel point P in the large gamut area;

determining a hue plane in which the target pixel point P is located according to the first coordinate value, and determining (H, C, L) of the target pixel point P, wherein H is a hue angle of the target pixel point P and (C, L) is a coordinate of the target pixel point P in the hue plane;

mapping the target pixel point P to the small gamut area according to (H, C, L) to acquire a second coordinate value of a mapped pixel point $P_1$ in the Lab color space; and acquiring mapped digital values of the mapped pixel point $P_1$ in the small gamut area according to the second coordinate value;

the step of mapping the target pixel point P to the small gamut area according to (H, C, L) to acquire the second coordinate value of the mapped pixel point $P_1$ in the Lab color space comprises:

determining that the target pixel point P is located outside the small gamut area or inside the small gamut area according to values of C and L;

acquiring a first reference point $P_i$ ($C(P_i)$, $L(P_i)$) of the target pixel point P in the small gamut area when the target pixel point P is located inside the small gamut area, wherein $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $\alpha$ is a preset adjusting coefficient, $\alpha\in[0, 1]$;

determining that the target pixel point P is located in a left side of the first reference point $P_i$ or a right side; and serving the first coordinate value of the target pixel point P as the second coordinate value of the mapped pixel point $P_1$ in the Lab color space when the target pixel point P is located in the left side of the first reference point $P_i$;

the step of acquiring the mapped digital values of the mapped pixel point $P_1$ in the small gamut area according to the second coordinate value comprises:

transforming a coordinate value of the mapped pixel point $P_1$ in the Lab color space into XYZ tristimulus values;

transforming the XYZ tristimulus values into RGB optical values by an inverse of a TM matrix; and inversely transforming the RGB optical values back into the mapped digital values of the mapped pixel point $P_1$.

2. The gamut mapping method for compressing the out-of-gamut area to the in-of-gamut area of claim 1, wherein the step of mapping the target pixel point P to the small gamut area according to (H, C, L) to acquire the second coordinate value of the mapped pixel point $P_1$ in the Lab color space further comprises:

determining a second reference point $P_s$ when the target pixel point P is located in the right side of the first reference point $P_i$, wherein $P_s$ is a connection point of an extending line in a border of the large gamut area, and the extending line connects the target pixel point P with $P_C$; and determining a coordinate value P' ($C_{p'}$, $L_{p'}$) in the small gamut area according to the second reference point $P_s$, wherein $L_{p'}=LLF$, $C_{p'}=(|PP_C|+|P_CP_i|)*|P_iP_C|)/(|P_SP_C|+|P_CP_i|)+C(P_i)$.

3. The gamut mapping method for compressing the out-of-gamut area to the in-of-gamut area of claim 1, wherein the step of mapping the target pixel point P to the small gamut area according to (H, C, L) to acquire the second coordinate value of the mapped pixel point $P_1$ in the Lab color space further comprises:

acquiring the first reference point $P_i$ ($C(P_i)$, $L(P_i)$) of the target pixel point P in the small gamut area and a second reference point $P_s$ when the target pixel point P is located outside the small gamut area, wherein $P_s$ is a connection point of an extending line in a border of the large gamut area, the extending line connects the target pixel point P with $P_C$, $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $P_C$ is a vertical connection point of the target pixel point P in a border of the small gamut area, and $L_F$ is a vertical connection point of $P_C$ in the vertical axis; and determining a coordinate value P' ($C_{p'}$, $L_{p'}$) in the small gamut area according to the second reference point $P_s$, wherein $L_{p'}=L(L_F)$, and $C_{p'}=(|PP_C|+|P_CP_i|)*|P_iP_C|)/(|P_SP_C|+|P_CP_i|)+C(P_i)$.

4. The gamut mapping method for compressing the out-of-gamut area to the in-of-gamut area of claim 1, wherein the step of acquiring the first coordinate value of the target pixel point P in the Lab color space according to the digital values of the target pixel point P in the large gamut area comprises:

transforming the digital values of the target pixel point P into the RGB optical values;

transforming the RGB optical values into the XYZ tristimulus values by the TM matrix; and transforming the XYZ tristimulus values into the first coordinate of the target pixel point P in the Lab color space.

5. A gamut mapping method for compressing an out-of-gamut area to an in-of-gamut area, utilized for mapping a pixel point in a large gamut area of the out-of-gamut area to a small gamut area of the in-of-gamut area, wherein the method comprises the following steps of:

acquiring a first coordinate value of a target pixel point P in a Lab color space according to digital values of the target pixel point P in the large gamut area;

determining a hue plane in which the target pixel point P is located according to the first coordinate value, and determining (H, C, L) of the target pixel point P, wherein H is a hue angle of the target pixel point P and (C, L) is a coordinate of the target pixel point P in the hue plane;

mapping the target pixel point P to the small gamut area according to (H, C, L) to acquire a second coordinate value of a mapped pixel point $P_1$ in the Lab color space; and acquiring mapped digital values of the mapped pixel point $P_1$ in the small gamut area according to the second coordinate value.

6. The gamut mapping method for compressing the out-of-gamut area to the in-of-gamut area of claim 5, wherein the step of mapping the target pixel point P to the small gamut area according to (H, C, L) to acquire the second coordinate value of the mapped pixel point $P_1$ in the Lab color space comprises:

determining that the target pixel point P is located outside the small gamut area or inside the small gamut area according to values of C and L;

acquiring a first reference point $P_i$ ($C(P_i)$, $L(P_i)$) of the target pixel point P in the small gamut area when the target pixel point P is located inside the small gamut area, wherein $C(P_i)$, $\alpha C(P_C)$, $L(P_i)$, $L(L_F)$, $P_C$ is a vertical connection point of the target pixel point P in a border of the small gamut area, $L_F$ is a vertical connection point of $P_C$ in the vertical axis, a is a preset adjusting coefficient, $\alpha\in[0, 1]$;

determining that the target pixel point P is located in a left side of the first reference point $P_i$ or a right side; and serving the first coordinate value of the target pixel point P as the second coordinate value of the mapped pixel point $P_1$ in the Lab color space when the target pixel point P is located in the left side of the first reference point $P_i$.

7. The gamut mapping method for compressing the out-of-gamut area to the in-of-gamut area of claim 6, wherein the step of mapping the target pixel point P to the small gamut area according to (H, C, L) to acquire the second coordinate value of the mapped pixel point $P_1$ in the Lab color space further comprises:

determining a second reference point $P_s$ when the target pixel point P is located in the right side of the first reference point $P_i$, wherein $P_s$ is a connection point of an extending line in a border of the large gamut area, and the extending line connects the target pixel point P with $P_C$; and determining a coordinate value P' ($C_{p'}$, $L_{p'}$) in the small gamut area according to the second reference point $P_s$, wherein $L_{p'}=LLF$, $C_{p'}=(|PP_C|+|P_CP_i|)*|P_iP_C|)/(|P_SP_C|+|P_CP_i|)+C(P_i)$.

8. The gamut mapping method for compressing the out-of-gamut area to the in-of-gamut area of claim 6, wherein the step of mapping the target pixel point P to the small gamut area according to (H, C, L) to acquire the second coordinate value of the mapped pixel point $P_1$ in the Lab color space further comprises:

acquiring the first reference point $P_i$ ($C(P_i)$, $L(P_i)$) of the target pixel point P in the small gamut area and a second reference point $P_s$ when the target pixel point P is located outside the small gamut area, wherein $P_s$ is a connection point of an extending line in a border of the large gamut area, the extending line connects the target pixel point P with $P_C$, $C(P_i)=\alpha C(P_C)$, $L(P_i)$, $L(L_F)$, $P_C$ is a vertical connection point of the target pixel point P in a border of the small gamut area, $L_F$ is a vertical connection point of $P_C$ in the vertical axis, $P_C$ is a vertical connection point of the target pixel point P in a border of the small gamut area, and $L_F$ is a vertical connection point of $P_C$ in the vertical axis; and determining a coordinate value P' ($C_{p'}$, $L_{p'}$) in the small gamut area according to the second reference point $P_s$, wherein $L_{p'}=L(L_F)$, and $C_{p'}=(|PP_C|+|P_CP_i|)*|P_iP_C|)/(|P_SP_C|+|P_CP_i|)+C(P_i)$.

9. The gamut mapping method for compressing the out-of-gamut area to the in-of-gamut area of claim 5, wherein the step of acquiring the mapped digital values of the mapped pixel point $P_1$ in the small gamut area according to the second coordinate value comprises:

transforming a coordinate value of the mapped pixel point $P_1$ in the Lab color space into XYZ tristimulus values;

transforming the XYZ tristimulus values into RGB optical values by an inverse of a TM matrix; and inversely transforming the RGB optical values back into the mapped digital values of the mapped pixel point $P_1$.

10. The gamut mapping method for compressing the out-of-gamut area to the in-of-gamut area of claim 5, wherein the step of acquiring the first coordinate value of the target pixel point P in the Lab color space according to the digital values of the target pixel point P in the large gamut area comprises:

transforming the digital values of the target pixel point P into RGB optical values;

transforming the RGB optical values into XYZ tristimulus values by a TM matrix; and transforming the XYZ tristimulus values into the first coordinate of the target pixel point P in the Lab color space.

11. A non-transitory computer readable storage medium, wherein the storage medium stores computer programs, a computer performs a gamut mapping method for compressing an out-of-gamut area to an in-of-gamut area when the programs are operated by the computer, the gamut mapping method for compressing the out-of-gamut area to the in-of-gamut area is utilized for mapping a pixel point in a large gamut area of the out-of-gamut area to a small gamut area of the in-of-gamut area, the method comprises the following steps of:

acquiring a first coordinate value of a target pixel point P in a Lab color space according to digital values of the target pixel point P in the large gamut area;

determining a hue plane in which the target pixel point P is located according to the first coordinate value, and determining (H, C, L) of the target pixel point P, wherein H is a hue angle of the target pixel point P and (C, L) is a coordinate of the target pixel point P in the hue plane;

mapping the target pixel point P to the small gamut area according to (H, C, L) to acquire a second coordinate value of a mapped pixel point $P_1$ in the Lab color space; and acquiring mapped digital values of the mapped pixel point $P_1$ in the small gamut area according to the second coordinate value.

12. The non-transitory computer readable storage medium of claim 11, wherein the step of mapping the target pixel point P to the small gamut area according to (H, C, L) to acquire the second coordinate value of the mapped pixel point $P_1$ in the Lab color space comprises:

determining that the target pixel point P is located outside the small gamut area or inside the small gamut area according to values of C and L;

acquiring a first reference point $P_i$ ($C(P_i)$, $L(P_i)$) of the target pixel point P in the small gamut area when the target pixel point P is located inside the small gamut area, wherein $C(P_i)$, $\alpha C(P_C)$, $L(P_i)$, $L(L_F)$, $P_C$ is a vertical connection point of the target pixel point P in a border of the small gamut area, $L_F$ is a vertical connection point of $P_C$ in the vertical axis, $\alpha$ is a preset adjusting coefficient, $\alpha \in [0, 1]$;

determining that the target pixel point P is located in a left side of the first reference point $P_i$ or a right side; and serving the first coordinate value of the target pixel point P as the second coordinate value of the mapped pixel point $P_1$ in the Lab color space when the target pixel point P is located in the left side of the first reference point $P_i$.

13. The non-transitory computer readable storage medium of claim 12, wherein the step of mapping the target pixel point P to the small gamut area according to (H, C, L) to acquire the second coordinate value of the mapped pixel point $P_1$ in the Lab color space further comprises:

determining a second reference point $P_s$ when the target pixel point P is located in the right side of the first reference point $P_i$, wherein $P_s$ is a connection point of an extending line in a border of the large gamut area, and the extending line connects the target pixel point P with $P_C$; and determining a coordinate value P' ($C_{p'}$, $L_{p'}$) in the small gamut area according to the second reference point $P_s$, wherein $L_{p'}$=LLF, $C_{p'}=(|PP_C|+|P_CP_i|)*|P_iP_C|)/(|P_SP_C|+|P_CP_i|)+C(P_i)$.

14. The non-transitory computer readable storage medium of claim 12, wherein the step of mapping the target pixel point P to the small gamut area according to (H, C, L) to acquire the second coordinate value of the mapped pixel point $P_1$ in the Lab color space further comprises:

acquiring the first reference point $P_i$ ($C(P_i)$, $L(P_i)$) of the target pixel point P in the small gamut area and a second reference point $P_s$ when the target pixel point P is located outside the small gamut area, wherein $P_s$ is a connection point of an extending line in a border of the large gamut area, the extending line connects the target pixel point P with $P_C$, $C(P_i)=\alpha C(P_C)$, $L(P_i)=L(L_F)$, $P_C$ is a vertical connection point of the target pixel point P in a border of the small gamut area, $L_F$ is a vertical connection point of $P_C$ in the vertical axis, $P_C$ is a vertical connection point of the target pixel point P in a border of the small gamut area, and $L_F$ is a vertical connection point of $P_C$ in the vertical axis; and determining a coordinate value P' ($C_{p'}$, $L_{p'}$) in the small gamut area according to the second reference point $P_s$, wherein $L_{p'}=L(L_F)$, and $C_{p'}=(|PP_C|+|P_CP_i|)*|P_iP_C|)/(|P_SP_C|+|P_CP_i|)+C(P_i)$.

15. The non-transitory computer readable storage medium of claim 11, wherein the step of acquiring the mapped digital values of the mapped pixel point $P_1$ in the small gamut area according to the second coordinate value comprises:

transforming a coordinate value of the mapped pixel point $P_1$ in the Lab color space into XYZ tristimulus values;

transforming the XYZ tristimulus values into RGB optical values by an inverse of a TM matrix; and inversely transforming the RGB optical values back into the mapped digital values of the mapped pixel point $P_1$.

16. The non-transitory computer readable storage medium of claim 11, wherein the step of acquiring the first coordinate value of the target pixel point P in the Lab color space according to the digital values of the target pixel point P in the large gamut area comprises:

transforming the digital values of the target pixel point P into RGB optical values;

transforming the RGB optical values into XYZ tristimulus values by a TM matrix; and transforming the XYZ tristimulus values into the first coordinate of the target pixel point P in the Lab color space.

* * * * *